United States Patent [19]

Esser

[11] 3,982,784

[45] Sept. 28, 1976

[54] MULTI-FUNCTIONAL FURNITURE

[76] Inventor: Hans-Helmut Esser, Weichselstr. 28, 65-Mainz, Germany

[22] Filed: Sept. 10, 1975

[21] Appl. No.: 612,224

[30] Foreign Application Priority Data

Oct. 9, 1974 Germany ..... 2448188

[52] U.S. Cl. ..... 297/1; 108/12; 108/14; 297/118; 297/123

[51] Int. Cl.[2] ..... A47C 13/00

[58] Field of Search ..... 297/1-3, 297/118, 119, 123, 129, 134, 445, 446; 108/12, 14

[56] References Cited

UNITED STATES PATENTS

| | | | |
|---|---|---|---|
| 2,620,018 | 12/1952 | Pagano | 297/123 |
| 3,556,586 | 1/1971 | Beardmore | 297/118 X |
| 3,834,776 | 9/1974 | Becker | 297/118 X |

*Primary Examiner*—James C. Mitchell
*Attorney, Agent, or Firm*—Hans Berman

[57] ABSTRACT

A piece of furniture in which two side walls are joined to respective spaced edges of a back wall extending in a common direction so as to define a channel, and a partition perpendicular to the back and side walls bisects the channel, may constitute a chair for a child when the partition is horizontal to provide a seat, or a table when the piece rests on one of the side walls. Two such pieces can be interengaged to form an approximately cube-shaped hassock if each partition is partly slotted to receive the partition of the other piece.

10 Claims, 3 Drawing Figures

MULTI-FUNCTIONAL FURNITURE

This invention relates to multi-functional furniture, and particularly to a piece of furniture which may serve either as a chair or as a table.

Known multi-functional pieces of furniture are adapted to different applications by modifying spatial relationship of their elements. Their transformation requires some skill, and they may include relatively complex and correspondingly costly mechanisms if they are to perform their several functions equally successfully. They are not normally capable of being modified by small children, nor are their mechanisms childproof.

It is a primary object of this invention to provide multi-functional furniture which is simple and rugged, yet capable of being manufactured at low cost.

It is a more specific object of the invention to provide furniture which may be used safely by children of preschool age.

With these objects and others in view, as will hereinafter become apparent, the invention provides a piece of furniture which essentially consists of a back wall, two side walls, and a partition. The side walls are joined to respective spaced edges of the back wall extending in a common direction so that the three walls jointly define a channel open in the aforementioned common direction and having an open side remote from the back wall and bounded by the two side walls. The partition is fixedly fastened to the back wall and the side walls in the channel so that it has a free edge remote from the back wall which extends between the side walls. A recess or slot extends inward of the partition from the free edge toward the back wall.

When the piece of furniture is set up with its partition in a horizontal position, it provides a chair. When the partition is upright, the piece constitutes a table. Two identical pieces of the type described may thus constitute a table and a matching chair. They may also be interengaged in such a manner that the side walls of each piece are parallel to the partition of the other piece and close the channel in the other piece in both directions transverse to the partition, while the back wall of each piece closes the open side of the channel in the other piece between the side walls, and each partition is partly received in the slot of the other partition. The resulting assembly may serve as a hassock or as a container.

Other features, additional objects, and many of the attendant advantages of this invention will readily be appreciated from the following detailed description of a preferred embodiment when considered in connection with the appended drawing in which.

Figure 1:
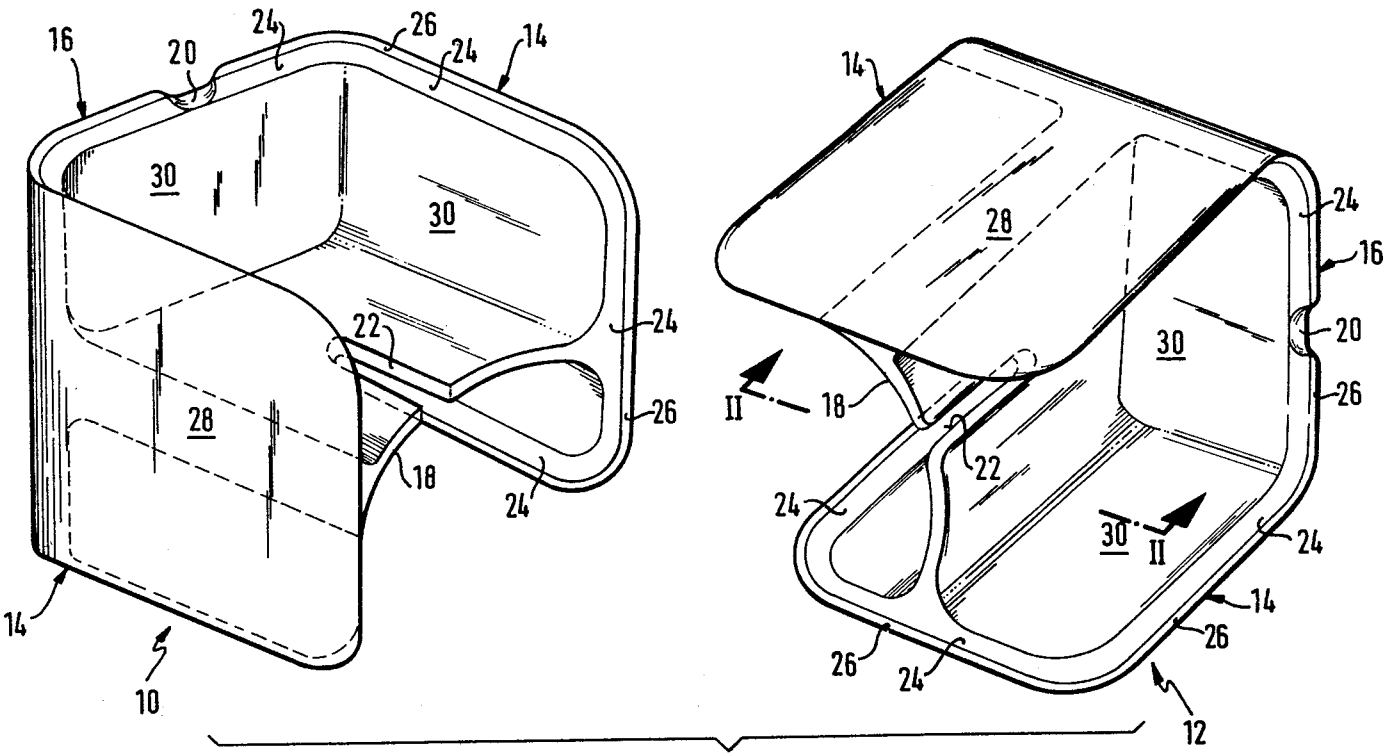
FIG. 1 shows a furniture set of the invention in a perspective view.

Referring now to the drawing in detail, and initially to FIG. 1, there are shown two identical pieces of furniture 10, 12, each having two side walls 14 joined to spaced parallel edges of a back wall 16 so that the three walls define a channel which is open in the direction of the back wall edges and also has an open side remote from the back wall 16 and bounded by free edges of the side walls 14. A notch 20 in an edge of the back wall 16 connecting the two side walls 14 provides a handhold, as will presently be explained.

A partition 18, transverse to the back and side walls, is fixedly fastened to the three walls in the channel and bisects the channel so that the piece 10, 12 is symmetrical relative to the median plane of the partition 18, and also relative to a plane parallel to the side walls 14 and centered between the walls 14. The free edge of the partition 18 extends from one side wall 14 to the other in a concave arc. A straight, elongated slot 22 extends inward of the partition 18 from the center of the free edge and is parallel to the side walls 14. The closed, inner end of the slot 22 is located at the approximate geometrical center of the channel so that its distance from the back wall 16 is equal to or somewhat smaller than one half the dimension of each side wall 14 in the direction of elongation of the slot 22.

Figure 2:
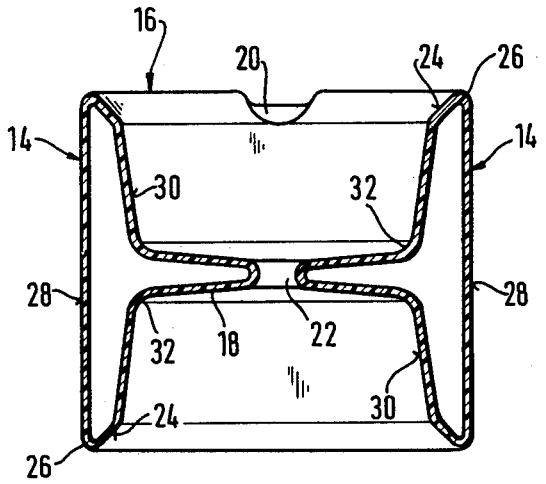
FIG 2 shows one of the pieces of furniture in plan section on the line II—II in FIG. 1.

Two free, narrow edge faces 24 of each wall 14, 16 are beveled so as to converge inward of the channel at respective angles of approximately 45° to the flat, outer faces 28 of the walls, as is best seen in FIG. 2, and each face 24 merges with the associated outer face 28 in a rounded edge 26. Similarly rounded corners 32 connect each inner face 30 of the walls 14, 16 with the partition 18 in sectional views parallel to that of FIG. 2. The thickness of each wall 14, 16 between the faces 28, 30 increases from the edge face 24 to the partition 18.

The walls 14, 16 and the partition 18 are hollow and bound communicating, sealed, air-filled chambers. Each piece of furniture 10, 12 may be made by rotational molding as an integral unit or of several parts from polyethylene powder, and by heat sealing of the parts to each other. The several elements of each piece of furniture thus are fixedly and permanently fastened to each other, and the piece floats in water.

The furniture piece 10 in FIG. 1 rests on a non-illustrated floor in a position in which the partition 18 is horizontal, and the piece provides a chair whose seat is formed by the partition. The furniture piece 12 rests on the outer face 28 of one of its side walls 14 so that the partition 18 is upright, and provides a table or desk matching the chair 10. The arcuately recessed free edge of each partition 18 provides adequate freedom of movement for the legs of a user, and the partition 18 in the table 12 contributes to the rigidity of the table.

Figure 3:
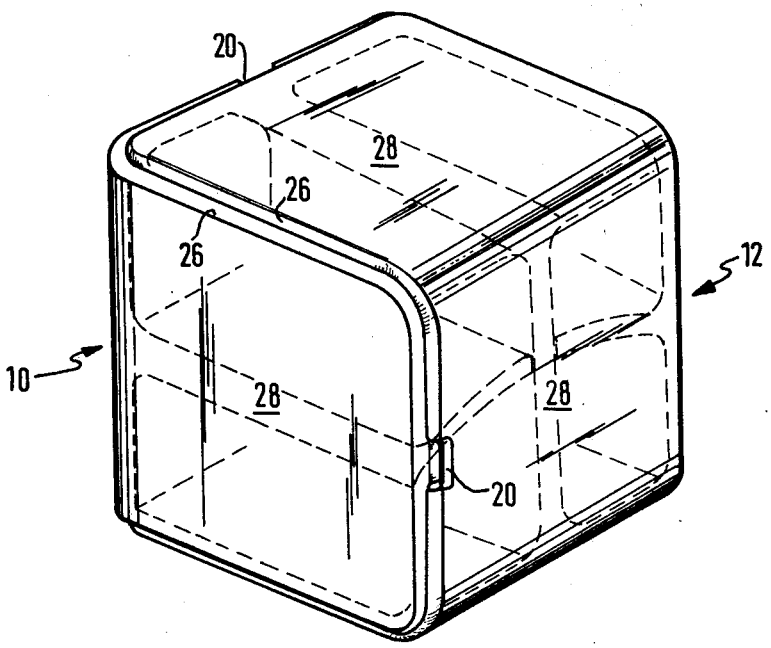
FIG. 3 is a perspective view of a container constituted by the interengaged pieces of the set of FIG. 1.

The chair 10 and table 12 may be slid on the floor toward each other until the side walls 14 of the table 12 are received in the upper and lower ends of the channel defined by the walls of the chair 10 and close the channel in an upward and downward direction. Each partition 18 is then received in part in the conforming slot 22 of the other partition 18, and the back wall 16 of the table 12 closes the open front of the chair 10. The resulting, cubical assembly is shown in FIG. 3. It forms a hassock or a storage container for toys whose cavity is protected against entry of dust by the matingly engaged edge faces 24 of the several walls 14, 16. When used as a hassock or other support, the assembly is greatly strengthened by the transversely interengaged partitions 18. The notches 20 facilitate separation of the assembled pieces 10, 12.

In an actual embodiment of the invention, the width of the chair 10, as measured between the planar outer faces 28 of the side walls 14, was 49 cm, the height of each wall 14, 16 was 45.6 cm, and the length of each side wall 14 between the upright edges of its outer face 28 was 47.3 cm. The assembly was a cube having sides of 49 cm each and rounded edges. The weight of the chair 10, and of the identical table 12, could readily be handled by nursery school children who quickly discovered additional applications for a set of more than two identical pieces of furniture of the illustrated type. The plastic material of construction may be colored to suit decorative or educational purposes, it is readily kept clean and sanitary, and it resists any mechanical stresses that children are capable of applying.

Larger pieces may serve to advantage as seats and desks in class rooms, particularly for temporary use, since pairs of pieces, when assembled in the manner shown in FIG. 3, may be stacked for storage requiring a minimum of floor space.

It should be understood, of course, that the foregoing disclosure relates only to a preferred embodiment of the invention, and that it is intended to cover all changes and modifications of the example of the invention herein chosen for the purpose of the disclosure which do not constitute departures from the spirit and scope of the invention set forth in the appended claims.

What is claimed is:

1. A piece of furniture comprising:

a. a back wall having two spaced edges extending in a common direction;

b. two side walls respectively joined to said edges, 1. said walls jointly defining a channel open in said common direction and having an open side remote from said back wall and bounded by said side walls; and c. a partition transverse to said back wall and to said side walls and fixedly fastened to said back wall and to said side walls in said channel, said partition having a free edge remote from said back wall and extending between said side walls, said partition being formed with a recess extending inward of said partition from said free edge toward said back wall.

2. A piece of furniture as set forth in claim 1, wherein said partition bisects said channel, and said recess is an elongated slot centered between said side walls, said slot having an inner longitudinal end spaced from said back wall a distance not greater than one half of the dimension of one of said side walls in the direction of elongation of said slot.

3. A piece of furniture as set forth in claim 2, wherein said back wall and said side walls have each two edge faces obliquely transverse to said common direction, the two edge faces of each of said walls converging toward said channel.

4. A piece of furniture as set forth in claim 2, wherein said back wall has an edge face transverse to said common direction and is formed with a notch in said edge face.

5. A piece of furniture as set forth in claim 2, wherein said back wall, said side walls, and said partition are hollow.

6. A piece of furniture as set forth in claim 5, wherein said back wall, said side walls, and said partition consist of thermoplastic synthetic resin composition, are fixedly and permanently fastened to each other, and enclose sealed, air-filled chambers.

7. A piece of furniture as set forth in claim 1, wherein said back wall is offset substantially at right angles from said side walls and said partition.

8. A container essentially consisting of two pieces of furniture as set forth in claim 7, the side walls of each of said pieces being parallel to the partition of the other piece and closing the channel of the other piece in said common direction, the back wall of each piece closing the channel of the other piece between the two side walls of said other piece, and the partition of each piece being received partly in the slot of the partition in the other piece.

9. A container as set forth in claim 8, wherein said two pieces of furniture are substantially identical in shape and dimensions, the container being of substantially cubical shape.

10. A furniture set consisting of two pieces of furniture as set forth in claim 2, said pieces being substantially identical in shape and dimensions.

* * * * *